US011937725B2

(12) United States Patent
Xu

(10) Patent No.: US 11,937,725 B2
(45) Date of Patent: Mar. 26, 2024

(54) FULL LIGHT-SHADING CURTAIN ROD

(71) Applicants: Jiaxiang Xu, Zhejiang (CN); Bo Liu, Zhejiang (CN)

(72) Inventor: Jiaxiang Xu, Zhejiang (CN)

(73) Assignees: Jiaxiang Xu, Hangzhou (CN); Bo Liu, Hangzhou (CN)

( * ) Notice: Subject to any disclaimer, the term of this patent is extended or adjusted under 35 U.S.C. 154(b) by 267 days.

(21) Appl. No.: 17/555,500

(22) Filed: Dec. 19, 2021

(65) Prior Publication Data

US 2023/0134364 A1 May 4, 2023

Related U.S. Application Data

(63) Continuation of application No. PCT/CN2021/127771, filed on Oct. 30, 2021.

(51) Int. Cl.
*A47H 1/142* (2006.01)
*A47H 1/02* (2006.01)

(52) U.S. Cl.
CPC ..... *A47H 1/142* (2013.01); *A47H 1/02* (2013.01); *A47H 2001/0205* (2013.01); *A47H 2001/021* (2013.01); *A47H 2001/0215* (2013.01)

(58) Field of Classification Search
CPC ..... A47H 1/142; A47H 1/12; A47H 1/102; A47H 2001/0215; A47H 2001/021; A47H 2001/0205; A47H 1/02; A14H 1/122
USPC ..... 403/277, 297, 289–290, 359.1–359.2, 403/358, 354; 248/253, 261–263
See application file for complete search history.

(56) References Cited

U.S. PATENT DOCUMENTS 872,689 A 12/1907 Sarkisian
1,349,041 A * 8/1920 Boye ..... A47H 1/022 248/263
1,376,542 A * 5/1921 Hills ..... A47H 1/142 248/262
1,424,337 A * 8/1922 Boye ..... A47H 1/142 211/105.2

(Continued)

FOREIGN PATENT DOCUMENTS

CN 201613486 U 10/2010
CN 108851922 A 11/2018

(Continued)

OTHER PUBLICATIONS

European Search Report of European Patent Application No. 21820073.1 dated May 19, 2023.

*Primary Examiner* — Christopher Garft

(57) ABSTRACT

The present application provides a full light-shading curtain rod including a curtain hanging rod, an end of the curtain hanging rod is provided with a corner structure, and the corner structure is configured for guiding a curtain hung on the curtain hanging rod to turn. It further includes a screen curtain hanging rod, and the screen curtain hanging rod is mounted at a side of the curtain hanging rod facing a wall foundation. An end of the corner structure is detachably connected with a mounting disc, and the corner structure and the mounting disc form a mounting assembly for mounting the curtain hanging rod on the wall foundation. An end of the screen curtain hanging rod is provided with a connecting bracket, and the connecting bracket is connected with the mounting assembly.

7 Claims, 6 Drawing Sheets

(56) References Cited

U.S. PATENT DOCUMENTS

| | | | | | |
|---|---|---|---|---|---|
| 1,498,456 | A * | 6/1924 | Kroder | A47H 1/122 | 248/263 |
| 1,593,943 | A * | 7/1926 | Thomas | A47H 1/02 | 248/261 |
| 1,832,086 | A * | 11/1931 | Boye | A47H 1/122 | 248/265 |
| 2,125,552 | A * | 8/1938 | Feldhoff | F16B 7/025 | 403/361 |
| 2,464,909 | A * | 3/1949 | Waddell | A47H 1/142 | 248/263 |
| 4,694,532 | A * | 9/1987 | Black | A47H 1/142 | 248/263 |
| 5,253,948 | A * | 10/1993 | Butler | B25G 3/28 | 403/348 |
| 8,341,775 | B2 * | 1/2013 | Didehvar | A47K 3/38 | 4/558 |
| 8,469,207 | B2 * | 6/2013 | Rowan | A47H 1/102 | 211/124 |
| 8,978,228 | B2 * | 3/2015 | Didehvar | A47K 3/38 | 29/434 |
| 2006/0130983 | A1 * | 6/2006 | Nien | A47H 1/02 | 160/330 |
| 2006/0260769 | A1 * | 11/2006 | Nien | A47H 1/142 | 160/330 |
| 2016/0073813 | A1 * | 3/2016 | Cheng | F16B 9/052 | 248/262 |

FOREIGN PATENT DOCUMENTS

| | | | |
|---|---|---|---|
| CN | 211022106 | U | 7/2020 |
| CN | 211647913 | U | 10/2020 |
| CN | 213308934 | U | 6/2021 |
| CN | 213993209 | U | 8/2021 |

* cited by examiner

FULL LIGHT-SHADING CURTAIN ROD

CROSS-REFERENCE TO RELATED APPLICATION

This application is a continuation of international PCT application serial no. PCT/CN2021/127771, filed on Oct. 30, 2021. The entirety of the above-mentioned patent application is hereby incorporated by reference herein and made a part of this specification.

TECHNICAL FIELD

The present application relates to the technical field of curtain rod, and particularly to a full light-shading curtain rod.

BACKGROUND ART

A hanging curtain is mainly composed of a curtain, a curtain rod, a curtain ring and other components, which has the functions of light shading, heat insulation and indoor light adjustment.

Currently, the curtain rod is mounted at an upper edge of a window via a structure such as a bracket, and curtain hooks are hung on individual curtain rings. Therefore, the light shading effect can be achieved simply by pulling the curtain.

However, when being used together with conventional curtain rods, a curtain has poor light shading effect, which negatively affects sleep.

SUMMARY

In order to improve light shading effect of a curtain, the present application provides a full light-shading curtain rod.

A full light-shading curtain rod provided in the present application adopts the following technical solution:

a full light-shading curtain rod including a curtain hanging rod, an end of the curtain hanging rod is provided with a corner structure, and the corner structure is configured to guide a curtain hung on the curtain hanging rod to turn.

In the above technical solution, an end of the curtain hanging rod is provided with a corner structure. After the curtain is hung on the curtain hanging rod, both sides of the curtain can be turned via a mounting rod to closely fit with the wall, so as to reduce the light leakage at a side of the curtain and improve light shading effect of the curtain.

Optionally, the full light-shading curtain rod further includes a screen curtain hanging rod, and the screen curtain hanging rod is provided at a side of the curtain hanging rod facing a wall foundation.

In the above technical solution, the screen curtain hanging rod is located on a side of the curtain hanging rod facing the window. Hanging a screen curtain on the screen curtain hanging rod, on the one hand, can adjust incident light in cooperation with the curtain, and, on the other hand, can be used separately to present different decorative styles.

Optionally, an end of the corner structure is connected with a mounting disc, and the corner structure and the mounting disc form a mounting assembly for mounting the curtain hanging rod on the wall foundation; and an end of the screen curtain hanging rod is provided with a connecting bracket, and the connecting bracket is connected with the mounting assembly.

In the above technical solution, the mounting disc is provided with a bolt at a center, and the corner structure is fixed on the mounting disc via the bolt. The mounting disc is fixed on the wall via an expanding bolt to provide a stable foundation for mounting the curtain rod.

Optionally, an end of the corner structure is fixedly connected with the mounting disc, an end of the screen curtain hanging rod is provided with the connecting bracket, and the corner structure and the connecting bracket on a same side are fixedly and integrally connection with each other via the mounting disc; and the mounting disc is configured to mount the curtain hanging rod and the screen curtain hanging rod on the wall foundation.

In the above technical solution, the mounting disc fixes the mounting rod and the connecting bracket on the wall in pairs. Then the screen curtain hanging rod is mounted between two connecting brackets, and the curtain hanging rod is mounted between two mounting rods. The mounting of the curtain rod is simple.

Optionally, the curtain hanging rod is detachably and fixedly connected with the corner structure, and/or the screen curtain hanging rod is detachably and fixedly connected with the connecting bracket.

In the above technical solution, the curtain hanging rod and the screen curtain hanging rod are in detachable and fixed connection with each other, so that the components of the curtain rod can be timely replaced, increasing the practicability of the curtain rod.

Optionally, the detachable and fixed connection of the curtain hanging rod and/or the screen curtain hanging rod is a threaded connection.

In the above technical solution, the threaded connection provides advantages of stable connection and simple structure, being conducive to production and effectively reducing production costs.

Optionally, the detachable and fixed connection of the curtain hanging rod and/or the screen curtain hanging rod is a snap connection including a snap structure and a snap-in structure, and the snap structure and the snap-in structure are separately provided at two opposite ends at a connection point; the snap structure includes a plurality of groups of elastic pieces arranged circumferentially, and an end of the elastic piece is fixedly connected with a catching edge; an end provided with the snap-in structure is provided with a cavity, a cavity wall of the cavity is provided with a sliding slot along an axial direction configured for the elastic piece to stretch into and a snap-in slot configured to cooperate with the catching edge, and the sliding slot and the snap-in slot is in communication with each other; and the cavity is provided with a fixing lump pressed the elastic piece outward from a center.

In the above technical solution, the snap fit has the advantage of simple operations for disassembling and assembling, and is convenient for a user.

Optionally, a diameter of the fixing lump is larger than a diameter of a ring encircled by the plurality of groups of elastic pieces, and a fixing lump is provided with a conical surface on a side facing outside the cavity.

In the above technical solution, when the curtain hanging rod is connected with the mounting rod, the elastic piece on the mounting rod is inserted into the sliding slot at the end of the curtain hanging rod, during which the fixing lump in the cavity applies a force onto the elastic piece via the conical surface to gradually press the elastic piece into the sliding slot. After the elastic piece is completely inserted, the elastic piece is pressed by the fixing lump to the maximum. Then, the curtain hanging rod is turned to slide the catching edge at an end of the elastic piece into a snap-in slot. The snap fit between the catching edge and the snap-in slot achieves a detachable and fixed connection between the curtain hanging rod and the mounting rod.

Optionally, the curtain hanging rod and the screen curtain hanging rod have a telescopic structure.

In the above technical solution, the curtain hanging rod and the screen curtain hanging rod have a telescopic structure, so that the curtain hanging rod can be adapted to windows with different sizes, so as to improve the adaptability of the curtain hanging rod.

Optionally, the connecting bracket includes a connecting piece connected between the corner structure and the mounting disc, a supporting rod configured to support the screen curtain hanging rod, and a connecting column configured to connect with the screen curtain hanging rod, and the connecting piece, the supporting rod and the connecting column are integrally formed with each other.

In the above technical solution, the connecting piece is configured to connect with the mounting assembly, and the connecting column is configured to connect with the screen curtain hanging rod. The supporting rod connects the connecting piece with the connecting column, so that the screen curtain hanging rod can be supported on one side of the curtain hanging rod.

Optionally, a mounting seat is provided at a junction of the mounting assembly and the connecting piece, and has a mounting surface and a back opposite to the mounting surface. The mounting surface of the mounting seat is provided with an upper receiving chamber configured to receive the connecting piece, and one side of the mounting seat located in an upper receiving chamber is provided with an outlet opening used for the supporting rod to extend out of the upper receiving chamber. The mounting seat is provided with a lower receiving chamber in the back for receiving the mounting disc, and is provided with a through-hole at a center.

In the above technical solution, the mounting seat provides a foundation for mounting the connecting piece and the mounting disc, and serves a function of positioning the connecting bracket, facilitating connecting the connecting bracket to the mounting assembly.

Optionally, the full light-shading curtain rod further includes a reinforcing rod, and the reinforcing rod is fixed on the wall foundation and supported under the curtain hanging rod and the screen curtain hanging rod.

In the above technical solution, the curtain rod can be added with the reinforcing rod depending on the weight of the hanging curtain. One end of the reinforcing rod is fixed on the wall, and the other end is supported under the curtain hanging rod and the screen curtain hanging rod to improve the stability of the curtain rod.

In summary, the present application includes at least one of the following beneficial technical effects.

1. By providing the corner structure at an end of the curtain hanging rod, the corner structure is used as a guiding rail for unfolding the curtain, so that the sides of the curtain can be turned and closely fit with the wall, thereby reducing light leakage at a side of the curtain and improve light shading effect of the curtain.
2. By providing the screen curtain hanging rod, on the one hand, the screen curtain can cooperate with the curtain to adjust incident light, and, on the other hand, can be used separately to present different decorative styles.
3. By providing the curtain hanging rod and the screen curtain hanging rod in detachable and fixed connection, parts of the curtain rod can be replaced timely to improve the practicability of the curtain rod.

DETAILED DESCRIPTION

The present application is further described in details below in combination with the accompanying drawings.

The present application discloses a full light-shading curtain rod.

Embodiment 1

Figure 1:
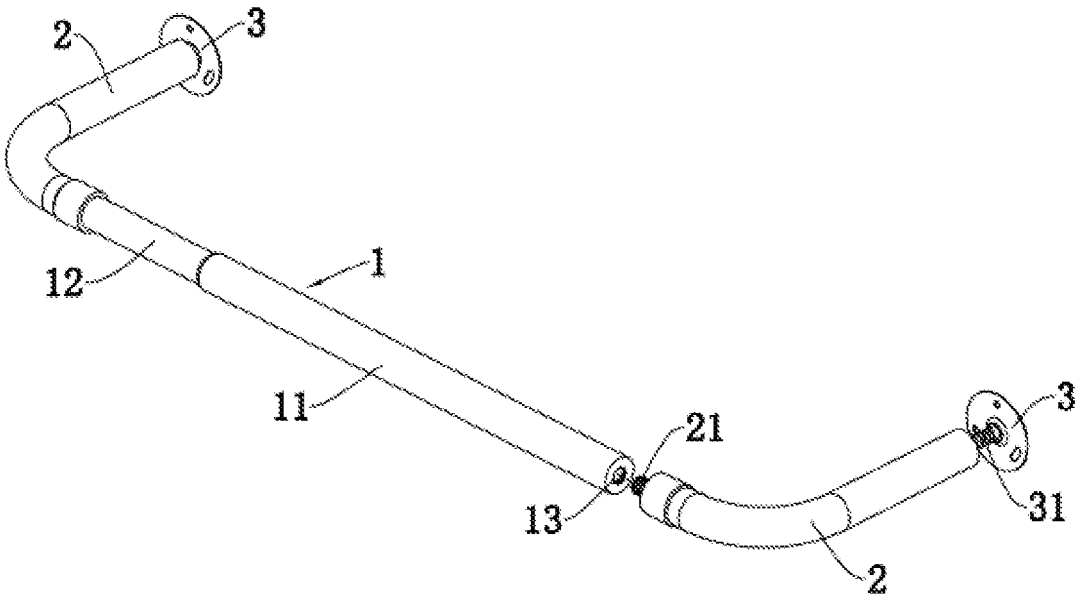
FIG. 1 is a structural diagram of Embodiment 1 of the present application.

Referring to the FIG. 1, a full light-shading curtain rod includes a curtain hanging rod 1, two groups of mounting rods 2 symmetrically provided at two ends of the curtain hanging rod 1, and a mounting disc 3 provided at one end of the mounting rod 2 away from the curtain hanging rod 1. The mounting rod 2 and the mounting disc 3 are assembled into a mounting assembly, being used for mounting the curtain hanging rod 1 at an upper edge of a window.

In particular, the curtain hanging rod 1 is a straight rod, and the mounting rod 2 is an arc bending rod. When they are connected with each other, the curtain hanging rod 1 is provided with a corner structure at both ends. Therefore, after the curtain is hung on the curtain hanging rod 1, both ends of the curtain can be turned at the corner via the mounting rod 2 and closely fitted with the wall, so as to reduce light leakage at a side of the curtain and improve light shading effect of the curtain.

The connection between curtain hanging rod 1 and the mounting rod 2 can be non-detachable fixed connection, such as welding or integrated connection, or detachable fixed connection, such as threaded connection or inserting connection. This embodiment is illustrated by using a threaded connection as an example. In particular, one end of the curtain hanging rod 1 connected with the mounting rod 2 is provided with a threaded section, and the other end is provided with a threaded hole 13. The threaded connection between the threaded section and the threaded hole 13 achieves a fixed connection between the curtain hanging rod 1 and the mounting rod 2. Alternatively, one end of the curtain hanging rod 1 or the mounting rod 2 is coaxially and fixedly connected with a threaded rod 21, the other end of the mounting rod 2 or the curtain hanging rod 1 is provided with a threaded hole 13. The fitting between additional threaded rod 21 and the threaded hole 13 achieves a fixed connection between the curtain hanging rod 1 and the mounting rod 2.

Further, the curtain hanging rod 1 is provided as a telescopic structure, so that the curtain hanging rod 1 can be adapted to windows with different sizes so as to improve the adaptability of the curtain hanging rod. The curtain hanging rod 1 includes an outer tube 11 and an inner rod 12, ends of the outer tube 11 and the inner rod 12 away from each other are respectively connected with a group of mounting rods 2, and the other end of the inner rod 12 is penetrated into the other end of the outer tube 11. The outer tube 11 and the inner rod 12 can be in interference fit or thread fit with each other, so that the inner rod 12 can move back and forth relative to the outer tube 11 to realize a telescopic function of the curtain hanging rod 1. An end of the outer tube 11 connected with the inner rod 12 is provided with a chamfer, so that this end of the outer tube 11 has an inclined structure, rendering the unfolding of the curtain smooth and reducing the occurrence of jamming.

The mounting disc 3 of the curtain rod is provided with a bolt 31 at a center thereof, and is fixedly provided at the end of the mounting rod 2 away from the curtain hanging rod 1. A plurality of through-holes are arranged on a surface of the mounting disc 3, and the mounting disc 3 is fixed on a wall through an expanding bolt to provide a stable mounting foundation for the curtain rod.

For mounting the curtain rod in this embodiment, two mounting rods 2 are mounted on both ends of the curtain hanging rod 1, the mounting disc 3 is mounted on the mounting rod 2, then the assembled curtain rod is moved to an upper edge of a window, an expanding bolt is penetrated through the mounting disc 3 to fix the curtain rod on the wall, thereby finishing the mounting of the curtain rod. Alternatively, the mounting rod 2 and the mounting disc 3 can be mounted at the upper edge of the window in advance, then the curtain hanging rod 1 is mounted between the two mounting rods 2. Whether the curtain is mounted at the curtain hanging rod 1 in advance is determined by whether it has an open-loop or closed-loop hanging ring.

Embodiment 2

Figure 2:
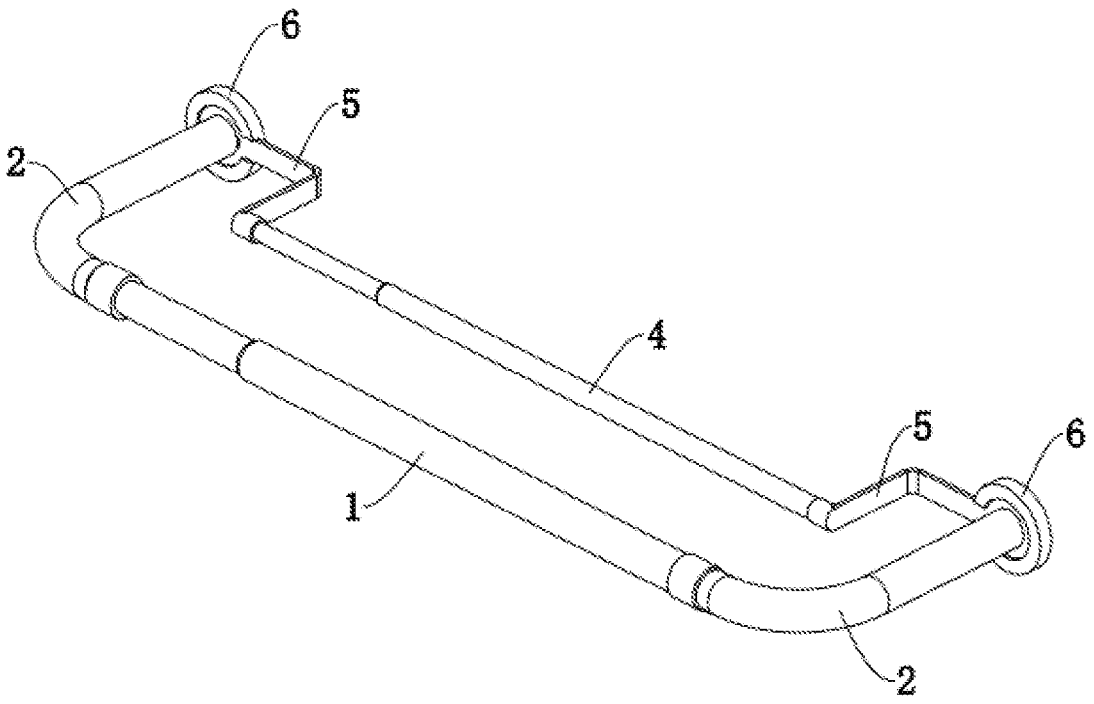
FIG. 2 is a structural diagram of Embodiment 2 of the present application.

This embodiment differs from Embodiment 1 in that, the full light-shading curtain rod further includes a screen curtain hanging rod 4, as shown in FIG. 2. Two ends of the screen curtain hanging rod 4 are respectively provided with a connecting bracket 5 for mounting it on a mounting assembly The screen curtain hanging rod 4 is located at one side of the curtain hanging rod 1 facing the window. Hanging the screen curtain on the screen curtain hanging rod 4, on the one hand, can adjust incident light in cooperation with the curtain, and, on the other hand, can be used separately to present different decorative styles.

Specifically, the screen curtain hanging rod 4 is a telescopic straight rod, having the same telescopic structure as the curtain hanging rod 1, that is, being composed of an outer tube and an inner rod.

Figure 3:
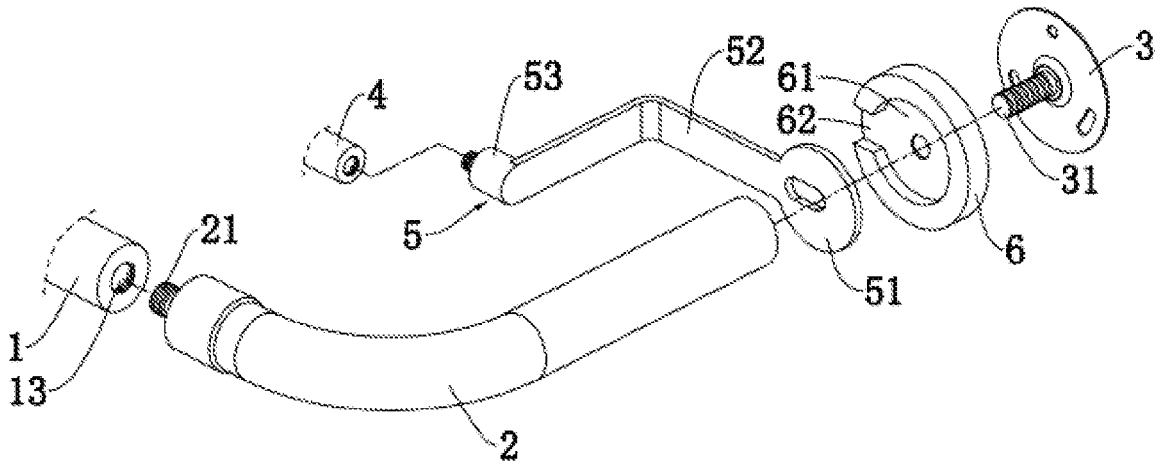
FIG. 3 is a structural diagram of a connecting bracket in Embodiment 2 of the present application.

Referring to FIG. 3, the connecting bracket 5 includes a connecting piece 51 connected between the mounting rod 2 and the mounting disc 3, a supporting rod 52 configured to support the screen curtain hanging rod 4, and a connecting column 53 configured to connect with the screen curtain hanging rod 4. The connecting piece 51, the supporting rod 52 and the connecting column 53 are integrally formed with each other. Here, the connecting piece 51 is of a disc shape and provided with a through-hole at a center for the bolt 31 to pass through. The supporting rod 52 is a folded rod, which, in this embodiment, has a folded angle of 90°. One end of the supporting rod 52 is connected to a peripheral edge of the connecting piece 51, and the main body of the connecting column 53 is cylindrical, being vertically connected to the other end of the supporting rod 52.

The connecting bracket 5 is connected with the screen curtain hanging rod 4 via the connecting column 53, optionally, by a threaded connection. The specific connection structure is the same as the threaded connection structure of the curtain hanging rod 1. For example, a threaded structure is provided on the connecting column 53, and a matching threaded hole 13 structure is provided on the screen curtain hanging rod 4, so as to realize a threaded connection therebetween. Alternatively, the connection between the connecting column 53 and the curtain hanging rod 4 can also be a non-detachable fixed connection.

A mounting seat 6 is further provided at a junction of the mounting assembly and the connecting piece 51, and has a mounting surface and a back opposite to the mounting surface. The mounting surface of the mounting seat 6 is provided with an upper receiving chamber 61 configured to receive the connecting piece 51, and one side of the mounting seat 6 located in an upper receiving chamber 61 is provided with an outlet opening 62 for the supporting rod 52 to extend out of the upper receiving chamber 61. The mounting seat 6 is provided with a lower receiving chamber in a back for receiving the mounting disc 3, and further provided with a through-hole at the center for the bolt 31 to pass through. The connecting piece 51 and the mounting disc 3 are provided behind the mounting seat 6, and all of them are arranged coaxially.

For mounting the curtain rod in this embodiment, the mounting disc 3 is fixed on a wall via the expanding bolt, and the mounting seat 6 is sleeved on the mounting disc 3, while the bolt 31 on the mounting disc 3 passes through the through-hole of the mounting seat 6. Then, the connecting piece 51 is placed in the upper receiving chamber 61 of the mounting seat 6, and the connecting piece 51 is sleeved on the bolt 31. The mounting rod 2 is connected with the bolt 31 so that the connecting piece 51 is pressed and fixed between the mounting rod 2 and the mounting disc 3, to complete the fixing and mounting of the connecting bracket 5 on the mounting assembly. Finally, the screen curtain hanging rod 4 and the curtain hanging rod 1 are respectively mounted to complete the mounting of the curtain rod.

Embodiment 3

Figure 4:
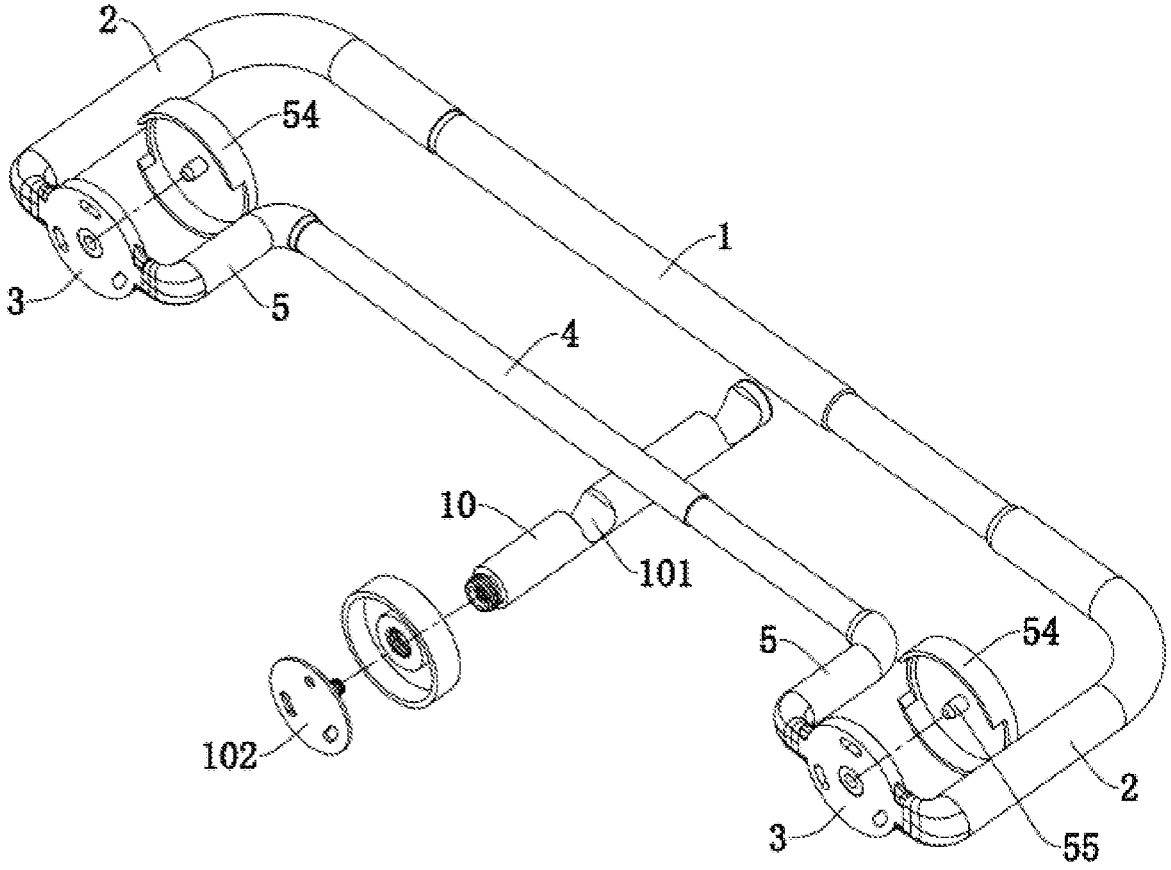
FIG. 4 is a structural diagram of Embodiment 3 of the present application.

This embodiment differs from Embodiment 2 in that, referring to FIG. 4, the connecting brackets 5 at both ends of the screen curtain hanging rod 4 are an arc bending-rod structure, in which one end of the connecting bracket 5 is connected with the screen curtain hanging rod 4, and the other end is connected with the mounting disc 3.

Specifically, the mounting rod 2 and the connecting bracket 5 are relatively provided on both sides of the mounting disc 3 and are fixedly connected with the mounting disc 3. The connection method can be welding.

For mounting the curtain rod of this embodiment, the mounting disc 3 is fixed on a wall via an expanding bolt, so that the mounting rod 2 and the connecting bracket 5 are arranged side by side. Then the screen curtain hanging rod 4 is mounted between two connecting brackets 5, and the curtain hanging rod 1 is mounted between the two mounting rods 2 to complete the mounting of the curtain rod. The mounting process is simpler.

In order to improve the decorative effect of the curtain rod, a protecting cover 54 is covered on a surface of the mounting disc 3 to hide the mounting disc 3 and the expanding bolt in its interior. A connecting column 55 is vertically fixed at a center inside the protecting cover 54. When covering the protecting cover 54, the connecting column 55 of the protecting cover 54 is passed through the through-hole of the mounting disc 3 to complete the fixed connection between the protecting cover 54 and the mounting disc 3.

The curtain rod can be added with a reinforcing rod 10 depending on the weight of a hanging curtain. The reinforcing rod 10 is located in the middle of the curtain rod, one end of the reinforcing rod 10 is fixed on the wall, and the other end is supported under the curtain hanging rod 1 and the screen curtain hanging rod 4. A rod body of the reinforcing rod 10 is provided with recesses 101 at intervals for receiving the curtain hanging rod 1 and the screen curtain hanging rod 4 to increase a contact area between the reinforcing rod 10 and the curtain hanging rod 1 or the screen curtain hanging rod 4 and improve the stability of the curtain rod. A fixing end of the reinforcing rod 10 is connected with a connecting disc 102, and the reinforcing rod 10 is fixed on the wall via the cooperation between the connecting disc 102 and the expanding bolt.

Embodiment 4

This embodiment differs from the other embodiments in that, the connection of the curtain hanging rod 1 and/or the screen curtain hanging rod 4 is snap connection in replace of threaded connection. Opposite ends of the curtain hanging rod 1 and/or the screen curtain hanging rod 4 at a connection point are respectively provided with a snap structure 7 and a snap-in structure 8.

Figure 5:
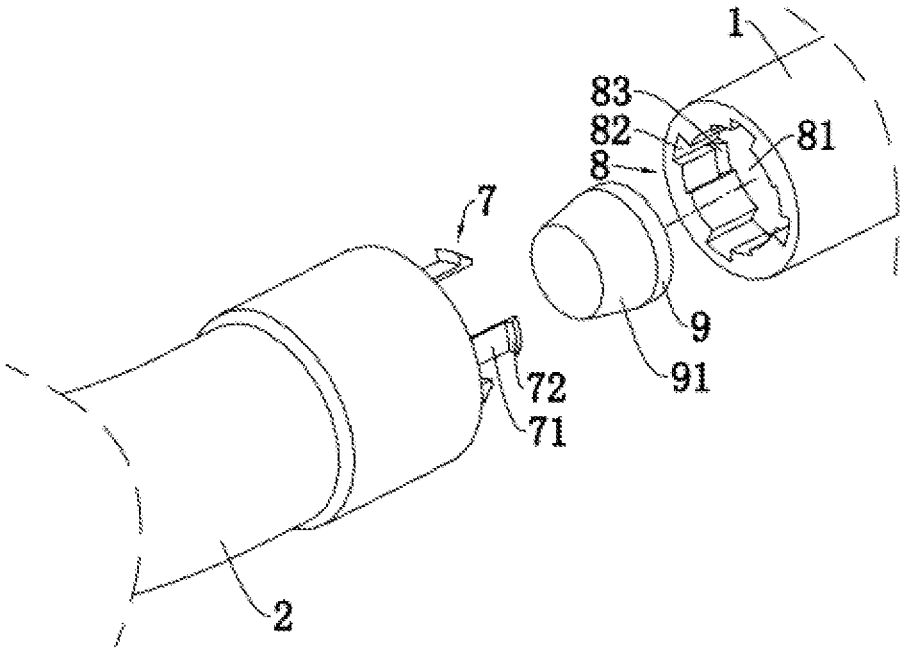
FIG. 5 is a structural diagram of Embodiment 4 of the present application.

Referring to the FIG. 5, in which the curtain hanging rod 1 is used as an example for illustration, the snap structure 7 includes a plurality of groups of elastic pieces 71 arranged at an end of the mounting rod 2 circumferentially, and one end of the elastic pieces 71 away from the mounting rod 2 is fixedly connected with a catching edge 72. An end of the curtain hanging rod 1 is provided with the snap-in structure 8 in cooperation with the snap structure 7. Specifically, an end of the curtain hanging rod 1 is provided with a circular cavity 81, a cavity wall of which is provided with a sliding slot 82 along the axial direction configured for the elastic piece 71 to stretch into and a snap-in slot 83 configured to cooperate with the catching edge 72. The snap-in slot 83 is located at a bottom of the cavity 81, and the sliding slot 82 and the snap-in slot 83 are in communication with each other. The cavity 81 is further provided with a fixing lump 9 which has a cylinder shape and presses the elastic piece 71 outward from a center. One end of the fixing lump 9 is fixed at a bottom of the cavity 81, and the other end extends towards the outside of the cavity 81, with a conical surface 91 arranged at this end. A diameter of the fixing lump 9 is larger than a diameter of a ring encircled by the plurality of groups of elastic pieces 71.

Figure 6:
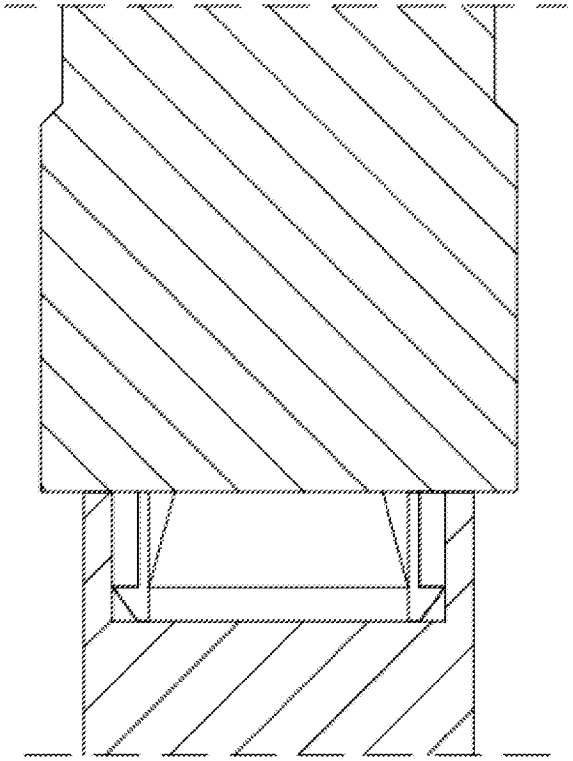
FIG. 6 is a diagram of a snap structure and a snap-in structure in matched state in Embodiment 4 of the present application.

Referring to the FIG. 6, for connecting the curtain hanging rod 1 with the mounting rod 2, the elastic piece 71 on the mounting rod 2 is inserted into the sliding slot 82 at an end of the curtain hanging rod 1, during which the fixing lump 9 in the cavity 81 applies a force onto the elastic piece 71 via the conical surface 91 to gradually press the elastic piece 71 into the sliding slot 82. After the elastic piece 71 is completely inserted, the elastic piece 71 is pressed by the fixing lump 9 to the maximum. Then, the curtain hanging rod 1 is turned to slide the catching edge 72 at the end of the elastic piece 71 into the snap-in slot 83. The snap fit between the catching edge 72 and the snap-in slot 83 achieves a detachable and fixed connection between the curtain hanging rod 1 and the mounting rod 2.

The positions of the snap structure 7 and the snap-in structure 8 on the mounting rod 2 and the curtain hanging rod 1 can be interchanged.

The above are the preferred embodiments of the present application, which are not intend to limit the protection scope of the present application. Therefore, all equivalent changes made according to the structure, shape and principle of the present application should be covered within the protection scope of the present application.

What is claimed is:

1. A full light-shading curtain rod comprising a curtain hanging rod, wherein an end of the curtain hanging rod is provided with a corner structure, and the corner structure is configured to guide a curtain hung on the curtain hanging rod to turn; the full light-shading curtain rod further comprises a screen curtain hanging rod, and the screen curtain hanging rod is provided at a side of the curtain hanging rod facing a wall foundation; wherein an end of the corner structure is detachably connected with a mounting disc, and the corner structure and the mounting disc form a mounting assembly for mounting the curtain hanging rod on the wall foundation; and an end of the screen curtain hanging rod is provided with a connecting bracket, and the connecting bracket is connected with the mounting assembly; wherein the connecting bracket comprises a connecting piece connected between the corner structure and the mounting disc, a supporting rod configured to support the screen curtain hanging rod, and a connecting column configured to connect with the screen curtain hanging rod, and the connecting piece, the supporting rod and the connecting column are integrally formed with each other; and wherein a mounting seat is provided at a junction of the mounting assembly and the connecting piece, and has a mounting surface and a back opposite to the mounting surface, the mounting surface of the mounting seat is provided with an upper receiving chamber configured to receive the connecting piece, and one side of the mounting seat where the upper receiving chamber is located is provided with an outlet opening configured for the supporting rod to extend out of the upper receiving chamber; and the mounting seat is provided with a lower receiving chamber for receiving the mounting disc in a back, and is provided with a through-hole at a center.

2. The full light-shading curtain rod according to claim 1, wherein the curtain hanging rod is detachably and fixedly connected with the corner structure, and/or the screen curtain hanging rod is detachably and fixedly connected with the connecting bracket.

3. The full light-shading curtain rod according to claim 2, wherein the detachable and fixed connection of the curtain hanging rod and/or the screen curtain hanging rod is a threaded connection.

4. The full light-shading curtain rod according to claim 2, wherein the detachable and fixed connection of the curtain hanging rod and/or the screen curtain hanging rod is a snap connection comprising a snap structure and a snap-in structure, and the snap structure and the snap-in structure are separately provided at two opposite ends at a connection point;

the snap structure comprises a plurality of groups of elastic pieces arranged circumferentially, and an end of the elastic piece is fixedly connected with a catching edge; and an end provided with the snap-in structure is provided with a cavity, a cavity wall of the cavity is provided with a sliding slot along an axial direction into which the elastic piece stretches and the cavity wall of the cavity is circumferentially provided with a snap-in slot that cooperates with the catching edge, and the sliding slot and the snap-in slot are in communication with each other; and the cavity is provided with a fixing lump pressed the elastic piece outwardly from a center.

5. The full light-shading curtain rod according to claim 4, wherein a diameter of the fixing lump is larger than a diameter of a ring encircled by the plurality of groups of elastic pieces, and a fixing lump is provided with a conical surface on a side facing outside the cavity.

6. The full light-shading curtain rod according to claim 1, wherein the curtain hanging rod and the screen curtain hanging rod have a telescopic structure.

7. The full light-shading curtain rod according to claim 1, wherein the full light-shading curtain rod further includes a reinforcing rod, and the reinforcing rod is fixed on the wall foundation and supported under the curtain hanging rod and the screen curtain hanging rod.

* * * * *